United States Patent [19]

List et al.

[11] Patent Number: 4,545,418

[45] Date of Patent: Oct. 8, 1985

[54] LOCKING DEVICE FOR CENTER FOLD HANGAR DOOR

[75] Inventors: John F. List, Edinburg; William M. Nunn, III, New Castle, both of Pa.

[73] Assignee: Fleming Steel Company, New Castle, Pa.

[21] Appl. No.: 641,260

[22] Filed: Aug. 16, 1984

[51] Int. Cl.[4] ..... E05D 15/00

[52] U.S. Cl. ..... 160/213; 160/207

[58] Field of Search ..... 160/213, 207

[56] References Cited

U.S. PATENT DOCUMENTS

| | | | |
|---|---|---|---|
| 1,841,185 | 1/1932 | Johnson | 160/193 |
| 2,238,181 | 4/1941 | Morgan | 160/213 X |
| 2,393,052 | 1/1946 | Mehard | 160/213 X |
| 2,936,830 | 5/1960 | Mosher | 160/188 |
| 3,024,838 | 3/1962 | Egleston et al. | 160/193 |
| 3,155,147 | 11/1964 | Smith | 160/207 X |
| 3,493,033 | 2/1970 | McGirr | 160/207 |
| 3,504,729 | 4/1970 | Alton | 160/188 |
| 4,088,172 | 5/1978 | Pollock | 160/207 X |
| 4,124,055 | 11/1978 | Aspenson et al. | 160/213 X |

*Primary Examiner*—Peter M. Caun
*Assistant Examiner*—David M. Purol
*Attorney, Agent, or Firm*—Harpman & Harpman

[57] ABSTRACT

A locking device for center fold hangar doors having an upper leaf and a lower leaf arranged when closed in vertically superimposed relation for movement relative to one another on a fixed horizontal axis to an elevated open position. A device is affixed to the abutting edges of the upper and lower leaf portions of the door having right angularly disposed telescopically positioned tubular members, one of which is pivoted to the doors on said horizontal axis and the other of which is secured at its outermost end to a bracket forming a portion of the device positioned in horizontally spaced relation to the doors. Locking means alternately secures the telescopically positioned tubular members to one another or permits their free telescopic movement. The device serves to lock the upper and lower leaf portions of the hangar door in vertically superimposed relation when the door is closed.

9 Claims, 6 Drawing Figures

LOCKING DEVICE FOR CENTER FOLD HANGAR DOOR

BACKGROUND OF THE INVENTION

1. Technical Field

This invention relates to center fold hangar doors sometimes call canopy-type doors as used in buildings having large openings such as airplane hangars.

2. Description of the Prior Art

Due to the large surface area of large center fold hangar doors, one of the problems associated with their use has been to adequately stabilize the door against wind gusts particularly when the door is in fully closed position. Extensible diagonal bracing struts have been used for this purpose as seen for example in U.S. Pat. Nos. 2,936,830 and 4,124,055. Locking devices attempting to secure such door assemblies in vertically superimposed relation are disclosed in U.S. Pat. Nos. 1,841,185, 3,024,838 and 3,504,729.

The present invention eliminates the problems that have been inherent in the prior art devices by providing a structure which movably positions telescopically arranged tubular members secured to the upper and lower door portions in a manner that requires relative movement of the tubular members when the upper and lower door portions move away from a vertical superimposed closed position and prevents such movement by selectively locking the tubular members to one another when the upper and lower portions of the door are in closed superimposed position.

SUMMARY OF THE INVENTION

A locking device for center fold hangar doors positions a pair of telescopically engaged tubular members in right angular relation to the horizontal fold line of the hangar door and pivotally attaches one of the telescopically arranged tubular members to the adjacent door edges and the other to a bracket which in turn is spaced horizontally from the door edges by support arms engaging the upper and lower door portions in spaced relation to the horizontal fold line therebetween. Locking means is provided for alternately locking the telescopically arranged tubular members to one another to prevent movement of the door sections from a vertical plane and alternately to release the tubular members to permit normal door opening and closing operation.

DESCRIPTION OF THE PREFERRED EMBODIMENT

Figure 1:
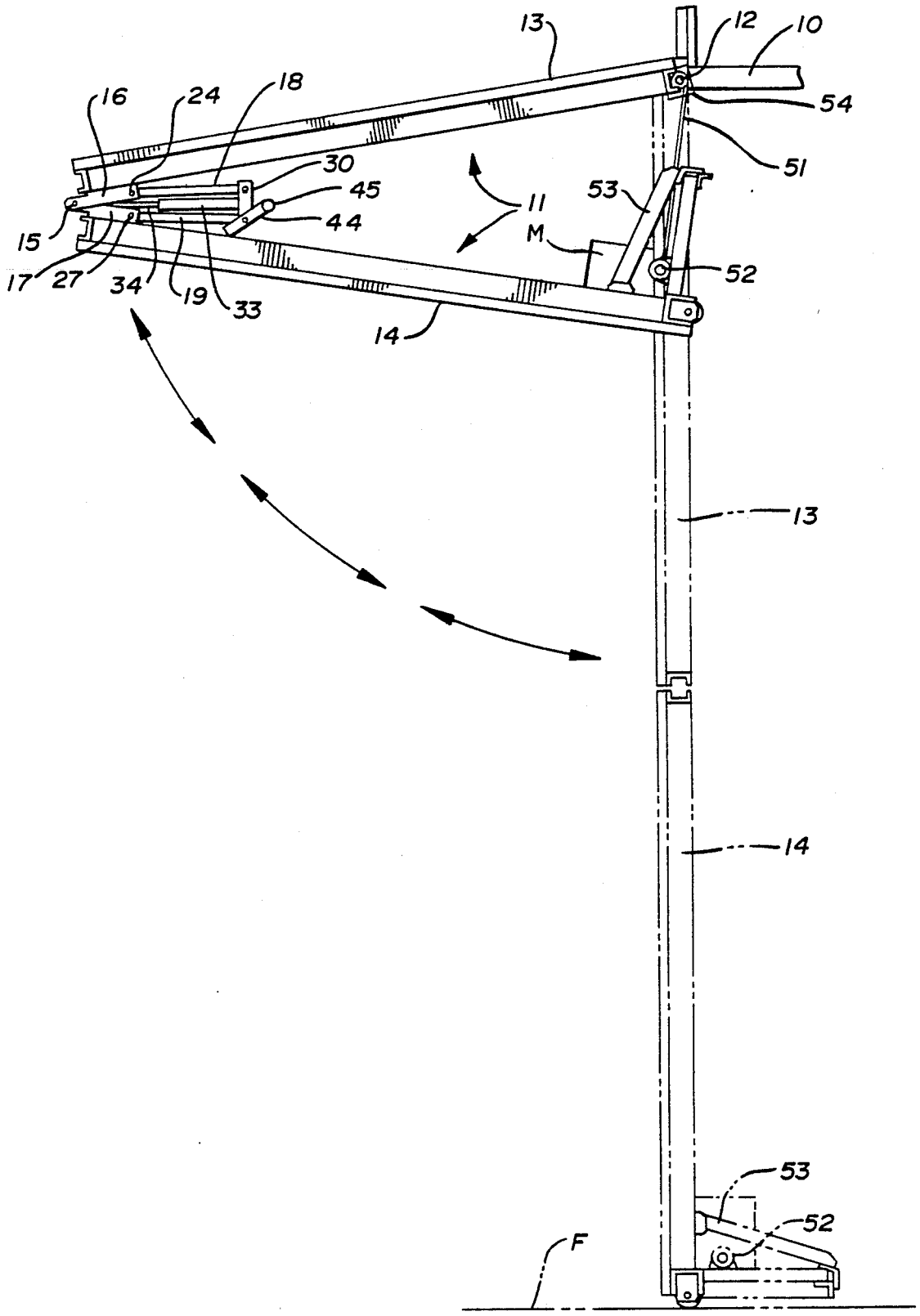
FIG. 1 is a side elevation of a center fold hangar door showing the same in solid lines in open position and in broken lines in closed position.
Figure 2:
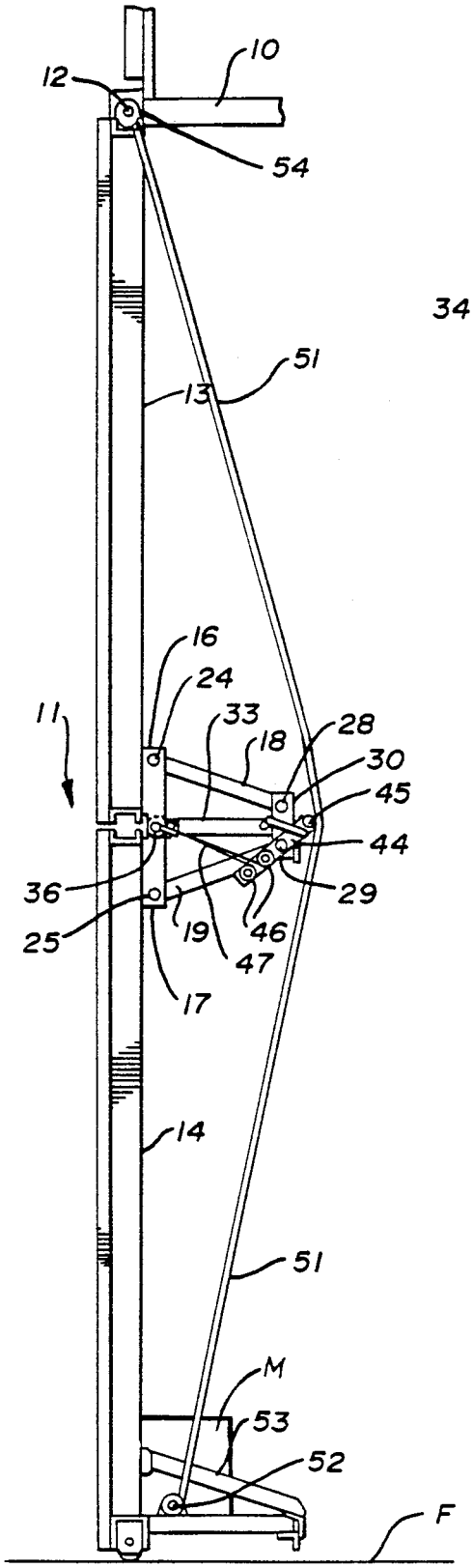
FIG. 2 is a side elevation of the center fold hangar door showing the same in closed position and illustrating a device for holding the door in closed position and preventing horizontal movement thereof.

By referring to FIGS. 1 and 2 of the drawings, a center fold hangar door will be seen in solid lines in FIGS. 1 and 2 in closed and open position respectively with respect to a door opening such as in a hangar structure or the like.

In FIG. 1 of the drawings, solid lines illustrate a portion 10 of an overhead door frame to which a center fold horizontal door generally indicated at 11 is pivotally secured as by a horizontal pivot or hinge structure 12. The center fold hangar door 11 consists of an upper leaf 13 and a lower leaf 14 pivoted to one another on the horizontal fold line therebetween by suitable pivots or hinges 15.

As illustrated in FIG. 1 of the drawings, the pivots or hinges 15 are positioned between channel brackets 16 and 17 which are respectively attached to the inner lower surface of the upper leaf 13 of the hangar door and the inner upper surface of the lower leaf 14 of the hangar door. The upper leaf 13 and the lower leaf 14 portions of the center fold hanger door are moved from closed position as shown in broken lines in FIG. 1 of the drawings to open position as shown in the solid lines in FIG. 1 of the drawings by suitable actuating means, such as a motor and gear box, which is attached to the lower portion of the lower leaf 14 of the center fold hangar door and flexible cables as will be understood by those skilled in the art.

In FIG. 1 of the drawings, the letter F designates the floor or threshold area of a hangar or other building in which the center fold hangar door is installed.

In FIGS. 1-4 of the drawings, the locking device invention as disclosed herein is illustrated as being mounted on the channel brackets 16 and 17 on the upper leaf 13 and lower leaf 14 of the center fold door respectively and including upper and lower arms 18 and 19 attached to tubular members 20, 21, 22 and 23 respectively on their opposite ends, the tubular members 20 and 21 being pivotally engaged on pins 24 and 25 respectively which are positioned in opposed openings in the channel brackets 16 and 17 respectively and secured by fasteners 26 and 27 respectively. The tubular members 22 and 23 on the opposite ends of the arms 18 and 19 are positioned on pins 28 and 29 respectively engaged in opposed openings in a cross sectionally U-shaped push plate 30, the pins being secured with respect to the push plate 30 by fasteners 31 and 32 respectively.

Figure 5:
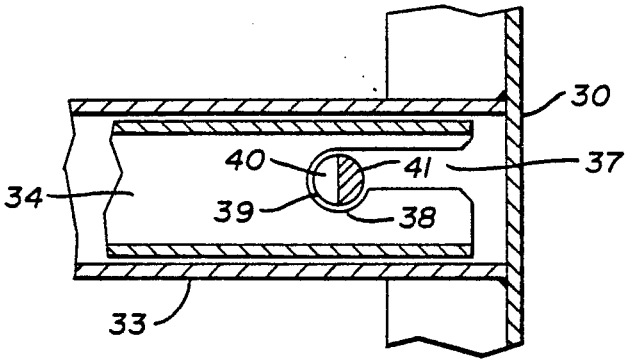
FIG. 5 is an enlarged horizontal section on line 5—5 of FIG. 4.
Figure 3:
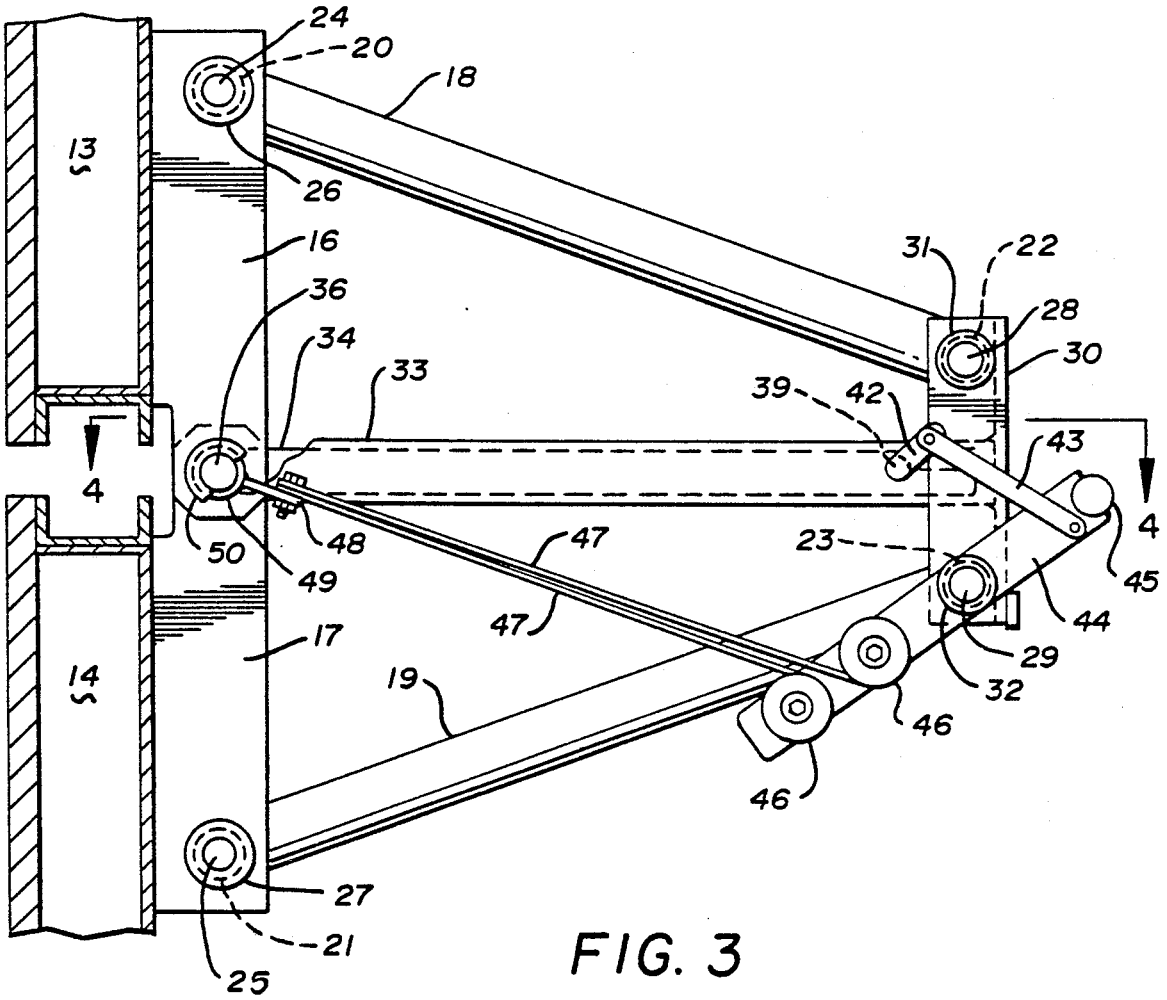
FIG. 3 is an enlarged side elevation of the device for holding the door in closed position.
Figure 4:
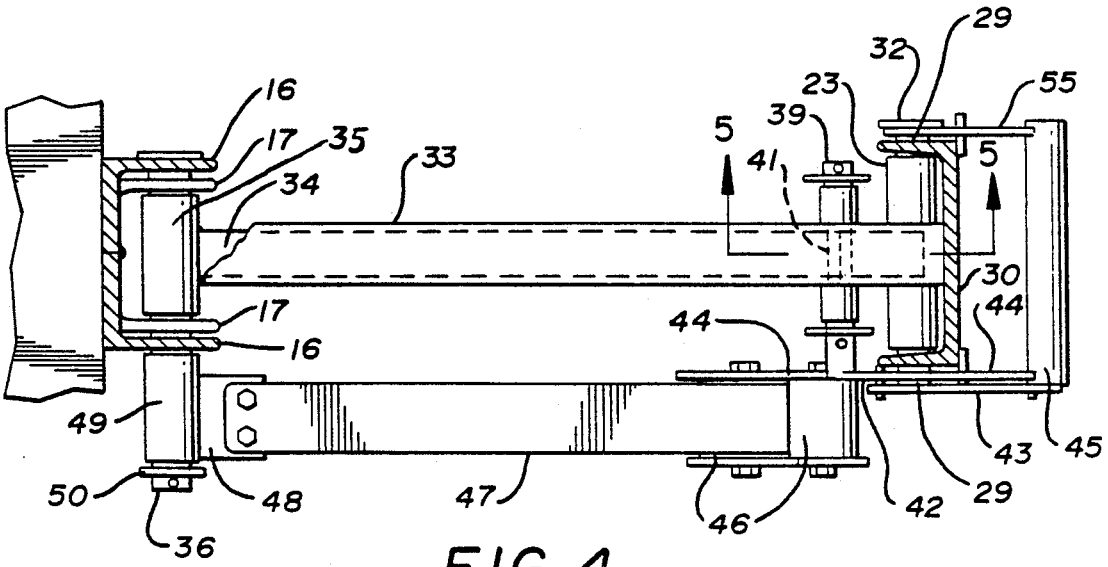
FIG. 4 is a horizontal section on line 4—4 of FIG. 3.

By referring to FIGS. 3, 4 and 5, it will be seen that an outer strut tube 33 is attached to the push plate 30 as by welding and extends on a horizontal plane toward the channel brackets 16 and 17 so as to telescopically receive an inner strut tube 34 which is attached at one of its ends to a secondary tubular member 35 which is movably positioned on a secondary pin 36 which is positioned in registering openings in the lower and upper ends respectively of the channel brackets 16 and 17 as best seen in FIG. 4 of the drawings. The opposite end of the inner strut tube 34 is slotted inwardly thereof as best seen in FIG. 5 of the drawings, the slot being indicated by the numeral 37 with the inner end of the slot being enlarged in a circular configuration 38. The pin 36 is one of the pivots 15 in FIG. 1.

By referring again to FIGS. 3 and 4 of the drawings, it will be seen that a lock pin 39 is rotatably positioned through opposed openings in the outer strut tube 33 in a position to register with the circular configuration 38 of the slot 37 in the inner strut tube 34 as hereinbefore described. The lock pin 39 as best illustrated in an enlarged perspective view of FIG. 6 of the drawings, has a center section 40 thereof cutaway so as to leave only a cross sectionally half circular section 41 which forms the locking portion of the lock pin 39. In FIG. 5 of the drawings, the locking portion 41 is shown partially rotated so that the same occupies the circular configuration 38 of the slot 37 and is thus of a greater height than the height of the communicating slot 37. The inner strut tube 34 is thus effectively locked to the outer strut tube 33 and any tendency of the upper and lower leaf portions of the center fold hangar door to move from superimposed vertical position as seen in broken lines in FIG. 1 and solid lines in FIG. 2, outwardly, to the left, is effectively blocked. Any outward movement of the horizontal meeting sections of the upper and lower portions of the hangar door such as occasioned by wind gusts, or partial vacuums formed by wind flowing over a hangar on which the center fold hangar door with the locking device of the invention installed thereon, must move the inner strut tube 34 to the left as seen in the several drawing figures and when it is locked to the outer strut tube 33 by the locking means just described, the outer strut tube being attached to the push plate 30 which in turn is spaced from the upper and lower leaf portions of the hangar door by the upper and lower arms 18 and 19 of the device makes such outward motion impossible and the desired superimposed vertical position of the upper and lower leaf portions of the hangar door is thus maintained. Contact between strut tube 33 and member 35 prevents inward movement of the door leaf portions.

Figure 6:
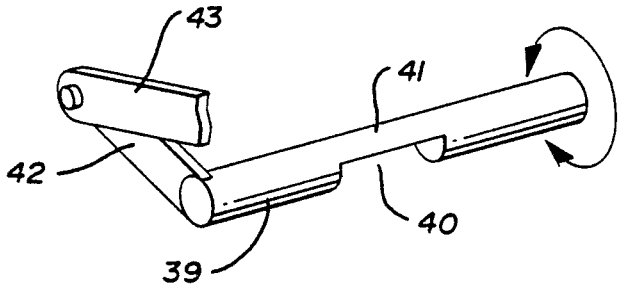
FIG. 6 is a perspective elevation of a portion of the locking device of FIGS. 2, 3, 4 and 5.

In FIGS. 2, 3 and 4 of the drawings, means for rotating the lock pin 39 from locking position as shown in FIG. 5 to unlocked position as shown in FIG. 6 are illustrated and comprise a lever 42 attached to the lock pin 39, a link 43 extends between a pivotal attachment to the lever 42 and a rocking lever 44 to which it is pivoted. The rocking lever 44 pivots substantially midway between its ends on the pin 29 and carries a transverse bar 45 on its outer end. A pair of extension spring units 46 are mounted on the other end of the rocking lever 44 and the springs 47 thereof are extended toward and attached to a mounting bracket 48 on a third tubular member 49 positioned on the secondary pin 36, which extends through the adjacent ends of the upper and lower channel brackets 16 and 17 as heretofore described. A fastener 50 secures the assembly as best seen in FIG. 4 of the drawings.

Springs 47 are under tension and normally urge the rocking lever 44 to the position illustrated in FIGS. 2, 3 and 4 of the drawings and thus cause the link 43 and the lever 42 to position the lock pin 39 in the position illustrated in FIG. 5 of the drawings.

In order that the locking device herein disclosed will be automatically actuated to unlock the outer strut tube 33 from the inner strut tube 34 when the center fold hangar door is to be opened, the transverse bar 45 must be moved toward the push plate 30.

Those skilled in the art will observe that center fold hangar doors are usually opened by cables, such as illustrated in FIG. 2 of the drawings, and indicated by the numeral 51 which are secured at their outermost ends to an upper portion of the center fold door as for example one or more fasteners 54 on an upper edge of the upper leaf portion 13. Rollers on the lower sides of the lower leaf 14 travel vertically in vertical guides that are part of the building door frame in which the center fold door is located.

The cables 51 are commonly arranged to be wound around a horizontal shaft 52 positioned on the lower leaf portion 14 of the center fold door along with a motor and gear reduction device M for revolving the shaft 52.

In the present disclosure, as seen in FIG. 2 of the drawings, the cable 51 is trained upwardly and outwardly and over the transverse bar 45 of the locking device hereinbefore disclosed and secured at or adjacent to the top hinge 12 by a fitting 54.

Rotary motion imparted the shaft 52 will thus take up the cable 51 as it moves outwardly and move the transverse bar 45 of the locking device toward the push plate 30 whereupon the lock pin 39 will partially revolve and move to the position shown in FIG. 6 of the drawings where the lock portion 41 will pass through the slot 37 in the inner strut tube 34 which is thus freed from its locked position in the outer strut tube 33. Continued outward motion of the cable 51 moves the transverse bar 45 against the push plate 30 which in turn applies this horizontal motion to the channel brackets 16 and 17 which are affixed to the adjacent edges of the upper and lower door sections and the same move outwardly, to the left, thus facilitating the opening of the center fold door as the outward and upward hinging action of the horizontal joining edges of the door sections necessitates the initial horizontal movement just described. Continuing take-up motion of the cable 51 moves the center fold hangar door to the position illustrated in solid lines in FIG. 1 of the drawings and automatically actuated limited switches stop the energizing means moving the cable when the center fold hangar door reaches a desired open position.

In order that the transverse bar 45 will transmit the horizontal motion imparted thereto by the cable 51 as just described, a support arm 55 extends between the transverse bar and the pin 29 which is positioned through the registering openings in the parallel flanges of the push plate 30.

It will occur to those skilled in the art that one or more of the locking devices as disclosed herein may be used on center fold hangar doors and each operated by a separate cable to accomplish the dual result of unlocking the locking device and lifting the door by first applying horizontal motion to the middle hinged section thereof and then vertical motion to lift the same to open position.

It will be seen that the locking device of the invention is relatively simply formed of a few working parts and once installed on a center fold door, needs little or no maintenance for continuous day to day operation when the hangar doors are opened and closed.

Having thus described our invention, what we claim is:

1. An improvement in a locking device for center fold hangar doors, said doors having an upper leaf including an upper portion pivotally mounted by an upper hinge for swinging about a fixed horizontal axis and a lower free edge adapted to be moved between a first elevated open position and a second lowered closed position; a lower leaf having an upper portion pivotally mounted on said lower free edge of said upper leaf and a lower portion, said upper portion of said lower leaf adapted to be moved between a first elevated open position and a second lowered closed position; the improvement comprising means pivotally joining the lower free edge of said upper leaf and the upper portion of said lower leaf for preventing horizontal movement in one direction of said upper leaf and said lower leaf when the same are in said second positions, said means including members on said upper leaf and said lower leaf and a pivot pivoting said members to one another, arms pivoted respectively to said members spaced from said pivot pivoting said members and a body member pivoted to said arms in spaced relation to said members, telescopic members positioned horizontally between said pivoted members and said body member, one of said telescopic members being pivotally affixed to the said pivot and the other of said telescopic members affixed to said body member and means for locking said telescopic members to one another when said upper leaf and said lower leaf are in said second positions.

2. The improvement in a locking device for center fold hangar doors set forth in claim 1 wherein said members on said upper leaf and said lower leaf and pivoted to one another are cross sectionally channel shaped brackets positioned with their adjacent ends in overlapping relation and wherein said pivot is positioned through said overlapping ends so as to position said pivot on a horizontal plane extending between said upper leaf and said lower leaf.

3. The improvement in a locking device for center fold hangar doors set forth in claim 1 and wherein said means for locking said telescopic members to one another is remotely actuated.

4. The improvement in a locking device for center fold hangar doors set forth in claim 3 and wherein said means for locking said telescopic members to one another includes a spring device normally urging said locking means into locked position.

5. The improvement in a locking device for center fold hangar doors set forth in claim 1 and wherein said means for locking said telescopic members to one another consists of a lock pin having a relatively narrow configuration inwardly of its ends, rotatable on its longitudinal axis and positioned transversely through said telescopic members and fixed with respect to an outer one of said telescopic members and in an enlarged portion of a slot formed longitudinally in the other of said telescopic members, whereby said other telescopic member may be moved longitudinally with respect to the outer telescopic member when said relatively narrow portion is positioned in registry with said elongated slot.

6. The improvement in a locking device for center fold hangar doors set forth in claim 5 and wherein a lever is affixed to an outer end of said lock pin, a second lever is pivotally mounted on said body member and a link is pivoted at its ends to said lever and said second lever and a transverse bar is positioned on said second lever in spaced relation to said body member whereby motion imparted said bar tilts said second lever and moves said link and lever to partially rotate said lock pin from a first locked position with respect to said telescopic members to a second unlocked position with respect to said telescopic members.

7. The improvement in a locking device for center fold hangar doors set forth in claim 6 and wherein a cable is attached to the upper hinge of said upper leaf of said center fold hangar door, means for taking up said cable so as to lift said lower leaf to said first elevated open position, said cable positioned to engage said transverse bar on said second lever so as to move the same horizontally toward said body member whereby said lock pin is partially rotated to unlocked position with respect to said telescopic members and the adjoining portions of said upper leaf and said lower leaf of said hangar door are moved horizontally and vertically from said second positions to said first positions.

8. The improvement in a locking device for center fold hangar doors set forth in claim 7 and wherein a spring device is positioned between said second lever and said members on said upper leaf and said lower leaf for normally urging a portion of said second lever and the transverse bar thereon to a position spaced with respect to said body member and said lock pin whereby said lock pin is partially rotated to locked position with respect to said telescopic members.

9. The improvment in a locking device for center fold hangar doors set forth in claim 7 and wherein said means for taking up said cable comprises a motor and gear reduction device on said lower leaf portion of said door, a shaft rotatably positioned horizontally on said lower leaf portion of said door, and means connecting said gear reduction device and said shaft for revolving the same to wind and unwind said cable thereabout.

* * * * *